US006312115B1

(12) United States Patent
Hara et al.

(10) Patent No.: US 6,312,115 B1
(45) **Date of Patent: *Nov. 6, 2001**

(54) INK CARTRIDGE FOR INK JET RECORDER AND METHOD OF MANUFACTURING SAME

(75) Inventors: Kazuhiko Hara; Minoru Usui; Kouichi Toba; Takao Kobayashi, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/041,890

(22) Filed: Mar. 12, 1998

(30) Foreign Application Priority Data

Mar. 12, 1997 (JP) ..... 9-076582

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | |
|---|---|---|---|
| 5,244,092 | 9/1993 | Karita et al. | 206/462 |
| 5,279,410 | 1/1994 | Arashima et al. | 206/723 |
| 5,495,272 | 2/1996 | Yamaguchi | 347/28 |

FOREIGN PATENT DOCUMENTS

| | | |
|---|---|---|
| 0 117 718 | 9/1984 | (EP) . |
| 0 261 764 | 3/1988 | (EP) . |
| 439 728 | 8/1991 | (EP) . |
| 0 495 649 | 7/1992 | (EP) . |
| 0 553 535 | 8/1993 | (EP) . |
| 0 576 237 | 12/1993 | (EP) . |
| 581531 | 2/1994 | (EP) . |
| 0 627 317 A1 | 12/1994 | (EP) . |
| 0 627 317 B1 | 12/1994 | (EP) . |
| 0 631 874 A2 | 1/1995 | (EP) . |
| 0 639 501 | 2/1995 | (EP) . |
| 0 640 484 | 3/1995 | (EP) . |
| 0 645 244 | 3/1995 | (EP) . |
| 0 663 295 | 7/1995 | (EP) . |
| 0 665 108 | 8/1995 | (EP) . |
| 0 685 340 | 12/1995 | (EP) . |
| 0 703 083 | 3/1996 | (EP) . |
| 0 726 154 | 8/1996 | (EP) . |
| 0 761 450 A2 | 3/1997 | (EP) . |
| 0 812 693 A1 | 12/1997 | (EP) . |
| 0 829 365 | 3/1998 | (EP) . |
| 0 631 874 B1 | 9/1999 | (EP) . |

(List continued on next page.)

OTHER PUBLICATIONS

Fuller, Timothy, et al., *Xerox Disclosure Journal*, vol. 21, No. 1 Jan./Feb. 1996, p. 25, Solution for Missing Jets in Thermal Ink Jet Devices.

Kuhman, Daniel, et al. *Xerox Disclosure Journal*, vol. 21, No. 3 May/Jun., 1996, p. 191–193, Method for Evacuating, Filling and Priming Thermal Ink Jet Printheads.

*Primary Examiner*—N. Le
*Assistant Examiner*—Anh T. N. Vo
(74) *Attorney, Agent, or Firm*—Stroock & Stroock & Lavan, LLP

(57) ABSTRACT

An ink tank cartridge for use in an ink jet recorder has a container having exterior walls, a porous member is stored in the container, an ink supply port that extends through one of the exterior walls of the body to supply ink to the exterior of the cartridge, and a packing member, disposed within the ink supply port and having an opening therethrough and a rib formed on a upper surface. A pressing member may be provided to bias the packing member against an inner surface of the ink supply port. The ink tank cartridge can be assembled to limit the occurrence of air bubbles in the ink.

14 Claims, 16 Drawing Sheets

FOREIGN PATENT DOCUMENTS

| | | |
|---|---|---|
| 2 293 140 | 3/1996 | (GB) . |
| 63 153 146 | 6/1988 | (JP) . |
| 63-153146 | 6/1988 | (JP) . |
| 63153146 | 6/1988 | (JP) . |
| 06 106 732 | 4/1994 | (JP) . |
| 0 615 846 | 9/1994 | (JP) . |
| 07 164 638 | 6/1995 | (JP) . |
| 07 276 629 | 10/1995 | (JP) . |
| 9-58009 | 4/1997 | (JP) . |

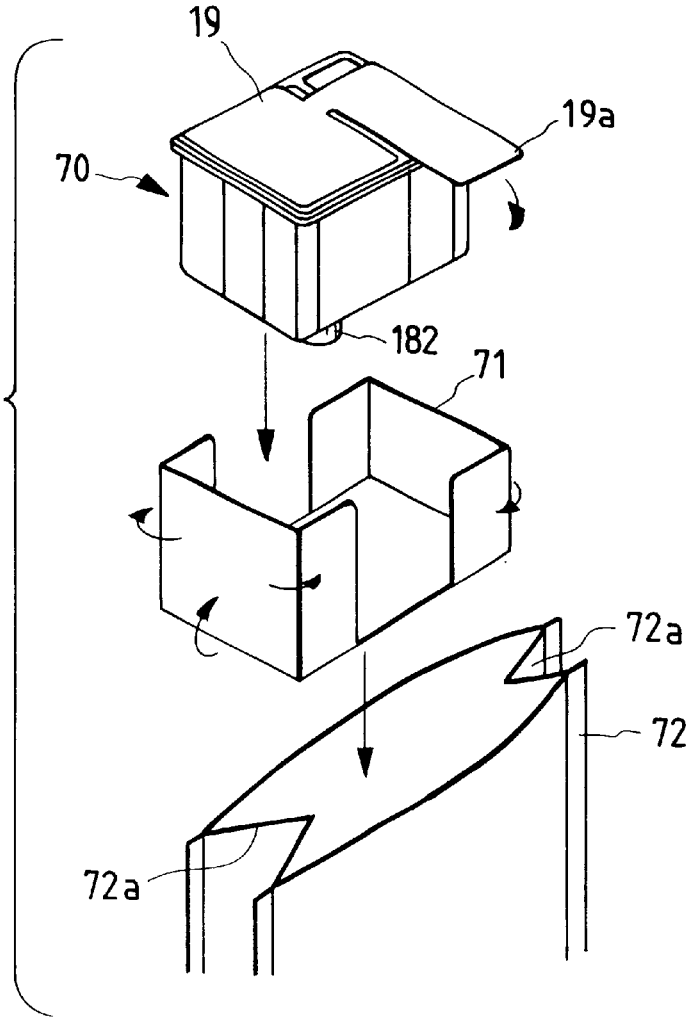
FIG. 20
FIG. 21A
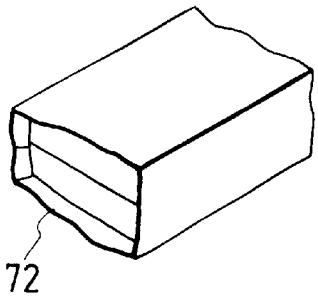
FIG. 21B
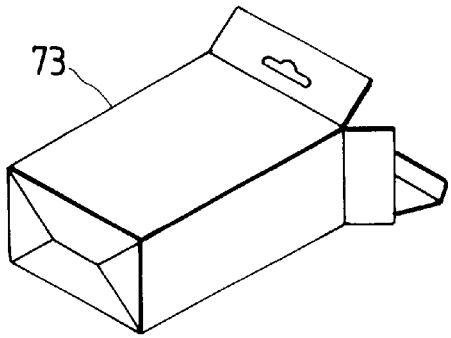

INK CARTRIDGE FOR INK JET RECORDER AND METHOD OF MANUFACTURING SAME

BACKGROUND OF THE INVENTION

The invention relates generally to an ink tank cartridge such as one that can be used with an ink-jet type recording apparatus and a method for manufacturing such an ink cartridge.

A conventional ink jet printer includes an ink container carried by a carriage equipped with an ink jet recording head. Ink droplets are produced by pressurizing the ink within a pressure generation chamber located within the ink container. However, when the carriage is pivoted, reciprocated, shaken or caused to travel during printing, the movement can cause the ink to become frothy or foamy. This, in turn, may result in a change in head pressure or otherwise cause print failures. Specifically, if ink contains gas bubbles, the pressure of the ink in the container can drop, thereby decreasing the ability of the printer to squirt or jet ink droplets onto a recording media. For this reason, dissolved air should be eliminated from the ink.

A prior art ink jet printer in which an ink-containing unit and an ink jet recording head are mounted on a carriage, is disclosed in European Patent Publication No. 581,531. In the disclosed printer, to prevent printing failures caused by fluctuation of ink head pressure or air bubbles, due to movement of the ink cartridge caused by the movement of the carriage, the ink container is divided into two regions. A first region of the container adjacent the recording head houses ink impregnated in a porous member, and a second region contains liquid ink without a porous member. This structure enables the ink to be conducted to the recording head via the porous member so that the problems resulting from movement of the ink in the cartridge are prevented from occurring to a certain extent.

To manufacture a container body with a porous material, one can seal the container body with a cover, fill the container with degassed ink, and package the ink container such that the quality of the ink cartridge is maintained during distribution. However, to these ends, the manufacturing steps become complicated, thereby resulting in a decrease in productivity.

To maintain an airtight and secure connection at the ink supply port between the ink cartridge and a recording head, a packing member composed of an elastic material can be inserted into the ink supply port. However, if even a minute gap exists between the packing, member and the ink supply port, air may exist in this gap and expand during the pressure drop which occurs during printing. The air can then enter the recording head, and prevent ink from being jetted from the recording head properly.

In addition, once an ink cartridge has been manufactured, it must be maintained in an airtight condition so that air cannot seep into the ink tank, as this can lead to the generation of foam in the ink prior to installation of the ink cartridge to the recording head.

Accordingly, it is desirable to develop an ink tank cartridge for use with an ink jet recorder and a method for manufacturing an ink cartridge for use in an ink jet recorder, that overcomes disadvantages and limitations of existing products and methods.

SUMMARY OF THE INVENTION

An ink tank cartridge for use in an ink jet recorder which is convenient to manufacture, assemble, store and connect, which helps prevent the formation of bubbles in the ink is provided. The cartridge can include a container body having exterior walls, a porous member stored in the container, an ink supply port that extends through one of the exterior walls of the body to supply ink to the exterior of the cartridge, and a packing member, disposed within the ink supply port and having an opening therethrough and a rib formed on a upper surface is provided. A pressing member may be provided to bias the packing member against an inner surface of the ink supply port. The ink cartridge for the ink jet recording apparatus can be constructed to exhaust air retained within the ink supply port. The ink tank cartridge can also be constructed to efficiently prevent air from entering into the ink cartridge through the ink supply port.

The present invention also provides a method of manufacturing an ink cartridge for use in an ink jet recorder, which can include the steps of: setting on a pallet a substantially rectangular container body, having an opening, so that the bottom surface of the container body faces upward, the container body including porous members formed from resilient material for absorbing ink, foam chambers for incorporating the porous members therein, and ink supply ports formed in the bottom surface of the foam chambers; inserting a packing member into each of the ink supply ports and heat-welding sealing film to the ink supply port openings; resetting the container body on the pallet by turning it upside down to its upright position; affixing filter material to the entrance side of the ink supply port; pressing the compressed porous member into each of the foam chambers; forming the container by bonding a cover to the opening of the container body; filling a specified quantity of ink into each of the foam chambers while the container is held in a vacuum environment; and bonding a seal to the surface of the cover.

Accordingly, it is an object of the invention to provide an ink cartridge and method of manufacture which overcomes drawbacks in the prior art.

Yet another object of the present invention is to provide a manufacturing method for efficiently manufacturing an ink cartridge and the cartridge which results, which avoids the problems associated with air bubbles in the ink.

The present invention has been contrived in view of drawbacks in the prior art, and an object of the present invention is to provide a manufacturing method that enables efficient and more simple manufacture of an ink cartridge for use in an ink jet recorder.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

FIG. 20 is an exploded view showing a first step of a packaging process in accordance with an ink cartridge manufacturing method of the present invention;

FIGS. 21A and 21B are schematic representations showing final steps of a packaging process in accordance with an ink cartridge manufacturing method of the present invention;

DESCRIPTION OF THE PREFERRED EMBODIMENTS

Figure 1:
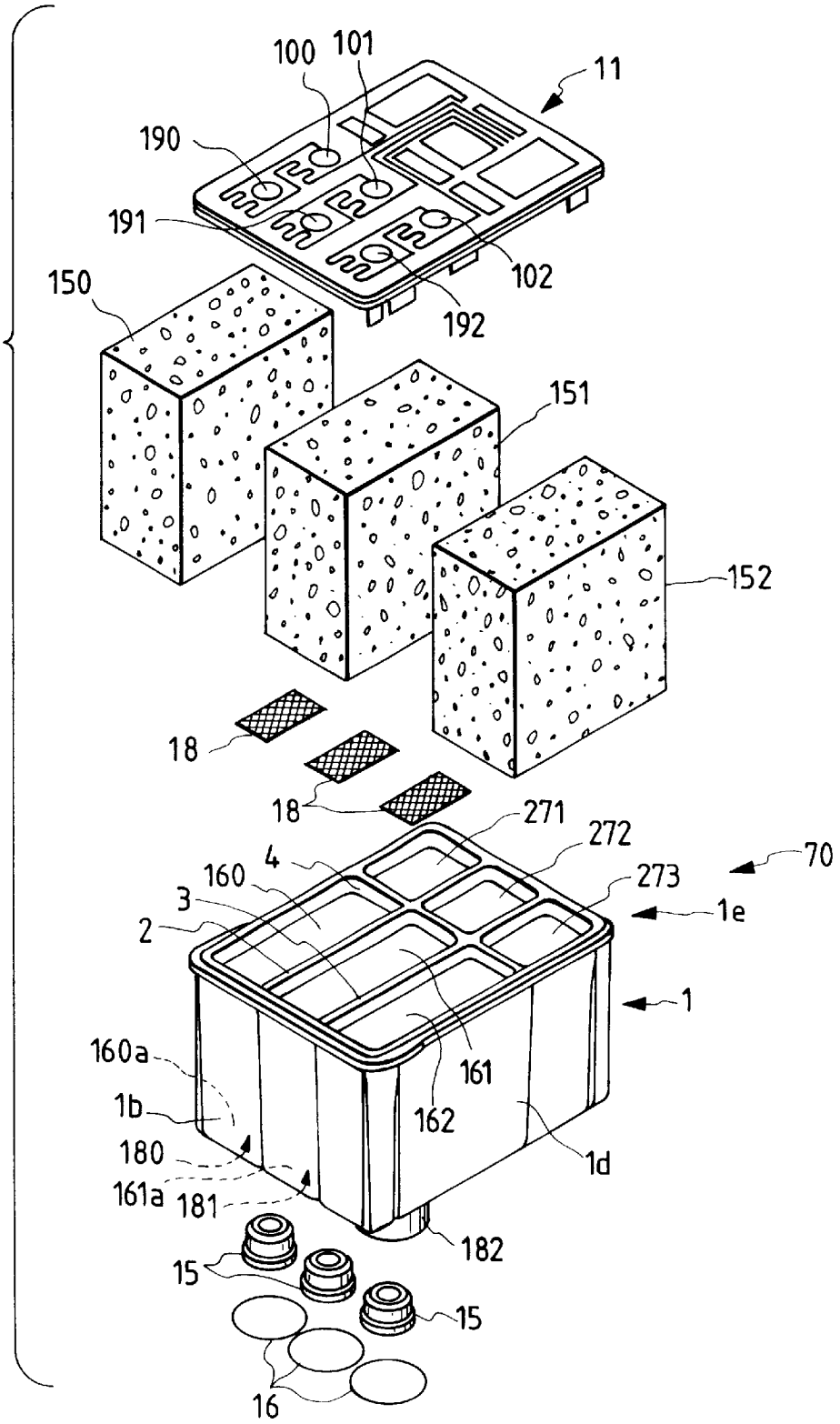
FIG. 1 is a perspective exploded view of a first embodiment of an ink cartridge according to a preferred embodiment of the present invention.

Reference is made to FIG. 1, which shows an ink cartridge 70 constructed in accordance with an embodiment of the present invention. Ink cartridge 70 includes a substantially rectangular parallelepiped container body 1, for containing ink, preferably cyan, magenta and yellow colored ink. Container body 1 is advantageously formed from polymeric material, such as polypropylene, polyethylene, or polystyrene, by injection molding, to facilitate heat welding of other members to the container body.

Container body 1 includes a bottom wall 1*a* (FIGS. 2,3), a front wall 1*b* and a back wall 1*c* extending upwardly from bottom wall 1*a*, and two side walls Id extending upwardly from bottom wall 1*a* and positioned between front wall 1*b* and back wall 1*c*. The distance from front wall 1b to back wall 1*c* and between side walls 1*d* gradually increases as walls 1*b*, 1*c*, 1*d* extend from bottom wall 1*a* to an opening 1e of container body 1 such that the cross sectional area of opening 1*e* is larger than the cross sectional area of bottom wall 1*a*.

Container body 1 is divided by a plurality of partitions 2, 3 and 4 to form three ink chambers 271, 272 and 273 for storing ink, with each chamber having a corresponding foam chamber 160, 161 and 162. Each foam chamber 160, 161, 162 is designed and constructed to accommodate a respective porous body 150, 151, 152, preferably made of a resilient material suitable for absorbing ink. Three ink supply ports 180, 181 and 182 are formed in bottom wall 1*a* below foam chambers 160, 161 and 162, respectively. Ink supply ports 180, 181 and 182 may be formed in front wall 1*b*, back wall 1*c* or side walls 1*d*. Packing members 15 fit into respective ink supply ports 180, 181, 182. A respective seal 16 is disposed over each packing member 15. Each ink chamber 271, 272, 273 is designed to contain a quantity of liquid ink 67.

The volumes of porous bodies 150, 151, 152 in their uncompressed condition are larger than the interior volume of respective foam chambers 160, 161, 162. Accordingly, upon insertion into foam chambers 160, 161 and 162, each of porous bodies 150, 151 and 152 is formed into and accommodated in a compressed condition.

Top opening 1e of container body 1 is sealed with a cover 11, that has exhaustion ports 190, 191, 192 formed therein and ink injection ports 100, 101, 102 formed at positions above ink supply ports 180, 181, 182 of foam chambers 160, 161, 162. Like container body 1, cover 11 is preferably formed of polypropylene, polyethylene, or polystyrene to facilitate heat welding.

When container body 1 is filled, ink 67 is preferably introduced into ink chambers 271, 272, 273 first, and thereafter passes through a communication hole 300 in partition 4 (FIG. 2) into foam chambers 160, 161, 162, where it is absorbed by porous bodies 150, 151, 152. During operation, ink 67 contained in ink chambers 271, 272, 273 is emptied first as ink 67 is taken up by porous bodies 150, 151, 152. After ink 67 contained in ink chambers 271, 272, 273 is depleted, ink 67 contained in foam chambers 160, 161, 162 is next consumed.

Figure 2:
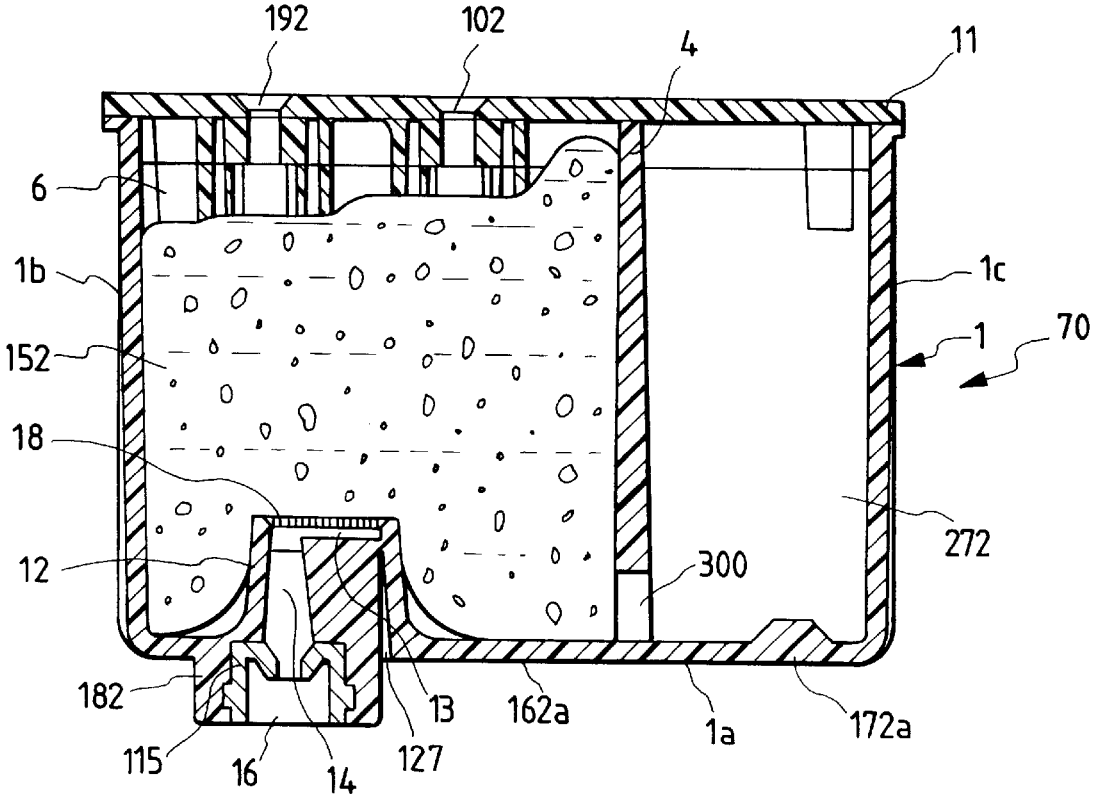
FIG. 2 is a side cross-sectional view of the ink cartridge depicted in FIG. 1.

Referring to FIG. 2, ink supply ports 180, 181, 182 are shaped to receive an ink supply needle of a recording head (not shown), and are formed in bottom walls 160*a*, 161*a*, 162*a* of respective foam chambers 160, 161, 162. Ink supply ports 180, 181, 182 each include an upper step portion 180*a*, 181*a*, 182*a*, a lower step portion 180*b*, 181*b*, 182*b*, and a lower surface 180*c*, 181*c*, 182*c*. A packing member 115 is disposed within each supply port 180, 181, 182 to prevent leakage.

Figure 3:
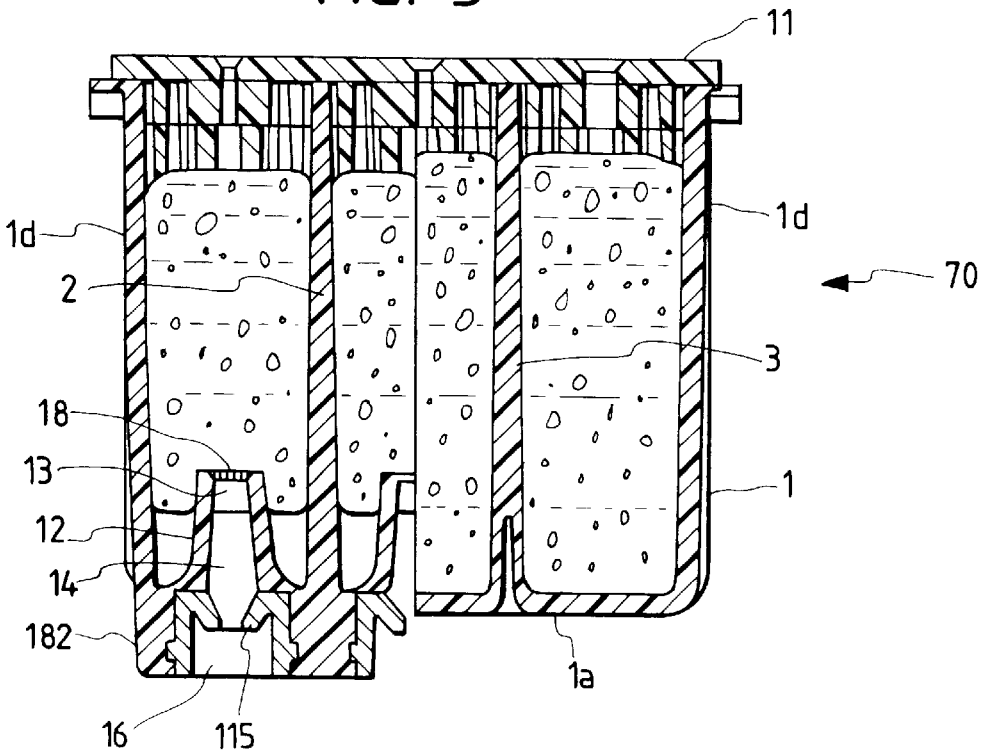
FIG. 3 is a front elevational cross-sectional view of the ink cartridge depicted in FIG. 1.

As is shown in FIGS. 2 and 3, a protuberance 12 extends upwardly from the bottom wall of each foam chamber 160, 161, 162, and acts to compress porous bodies 150, 151, 152 in cooperation with cover 11. A recess 13 is formed in the upper end of each protuberance 12 so as to constitute a vacancy having a volume. A fluid communication path 14 is formed through each protuberance 12 so as to extend to packing members 115 of ink supply ports 180, 181, 182, of which ink supply port 182 is shown. A filter 18 is fused onto protuberance 12 over recess 13.

During the manufacturing process, the surfaces of filter 18 and protuberance 12, including the walls defining recess 13 and communication path 14 and ink supply port 180, 181, 182, are preferably irradiated with ultraviolet rays or otherwise treated to improve the wettability of the surfaces. As such, with water based ink, the surfaces of the path traveled by ink 67 to the ink supply needle are made hydrophilic and ink 67 is more readily supplied to the ink supply needle. In addition, more of ink 67 is delivered to ink supply needle as less ink 67 adheres to the irradiated surfaces.

Figure 6:
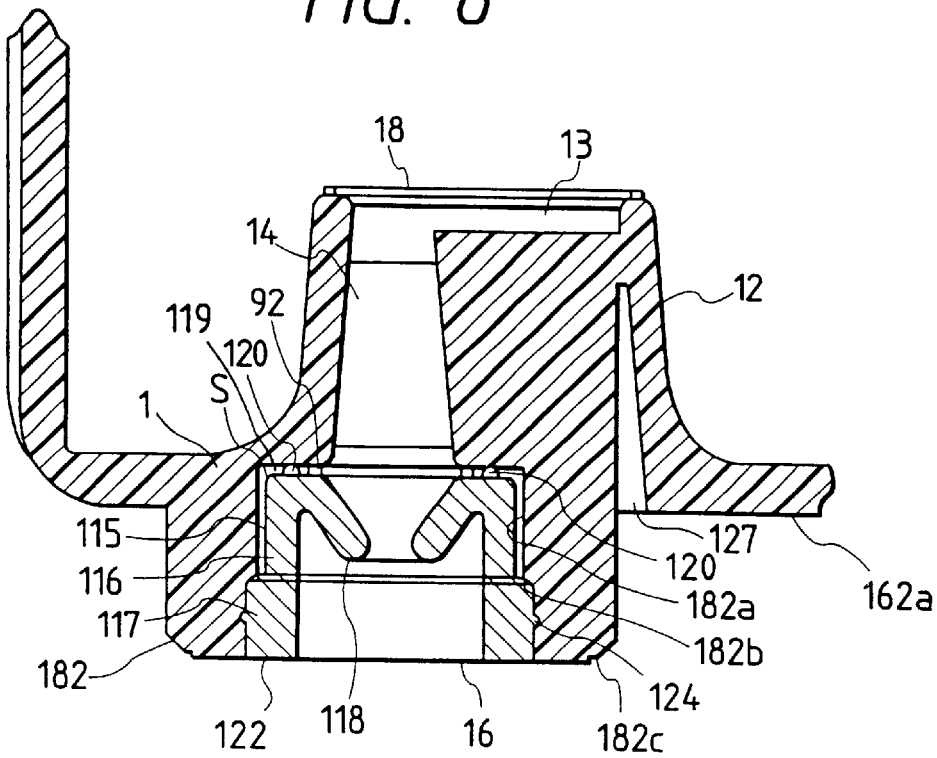
FIG. 6 is an enlarged front cross-sectional view of an ink supply port of an ink cartridge according to a preferred embodiment of the present invention.
Figure 7:
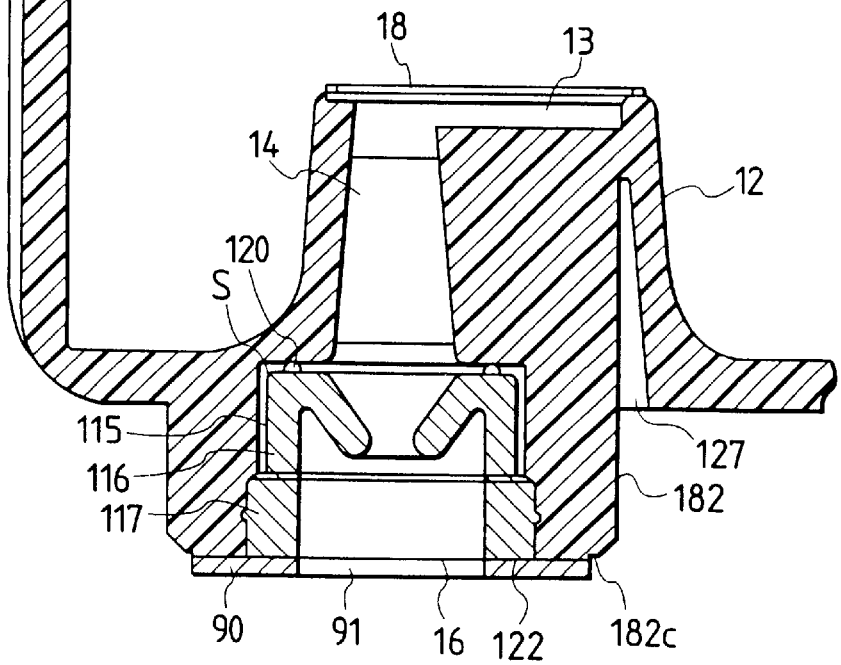
FIG. 7 is an enlarged front cross-sectional view of the ink supply port depicted in FIG. 6 with a pressing member.

As is shown in FIGS. 6 and 7, packing members 115 are disposed within ink supply ports 180, 181, 182, and are made of a resilient material, such as rubber or other elastomers. Packing members 115 include an upper tubular portion 116, a lower tubular portion 117, and a tapered portion 118, and form a fluid-tight fit with ink the supply needles (not shown) of the recording head when the ink supply needles are inserted into ink supply ports 180, 181, 182 and communication paths 14. While each communication path 14 and packing member 115 are described in detail as singular elements, it is understood that each protuberance 12 and ink supply port 180, 181, 182 include a communication path 14 and packing member 115.

Figure 4:
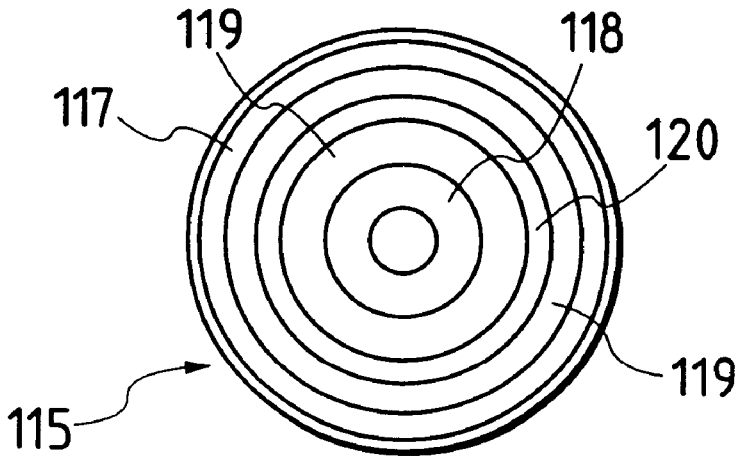
FIG. 4 is a plan view of a packing member of an ink cartridge according to a preferred embodiment of the present invention.
Figure 5:
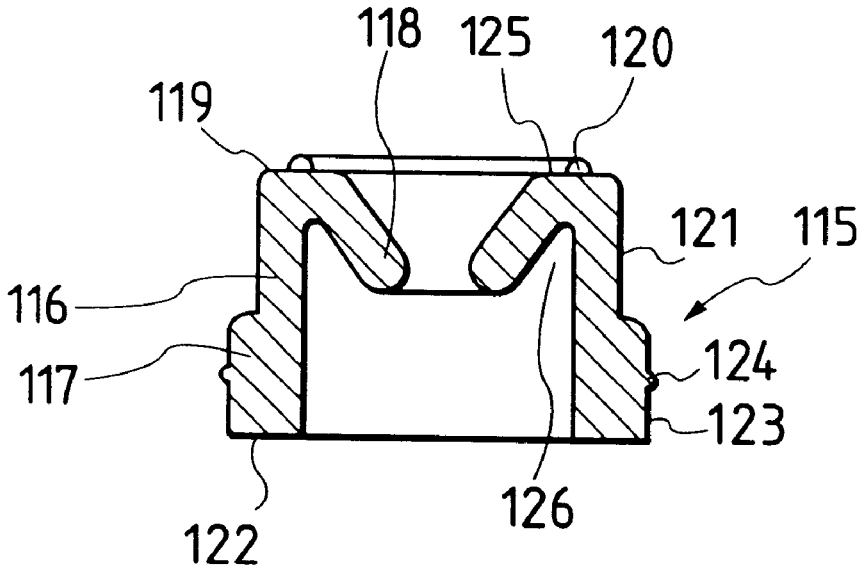
FIG. 5 is a cross-sectional view of the packing member depicted in FIG. 4.

Referring to FIGS. 4 and 5, the tops of packing members 115 are configured in a funnel shape that opens upward. Upper tubular portion 116 includes an upper surface 119 and an outer surface 121. Lower tubular portion 117 includes a lower surface 122, an outer surface 123, integral with upper surface 119, and an outer rib 124 preferably integral with outer surface 123. Lower tubular portion 117 is thicker than upper tubular portion 116. Tapered portion 118 includes an upper surface 125 and thin connection portions 126, which connect tapered portion 118 to upper tubular portion 116. A thin ringed rib 120 is advantageously integral with upper surface 119, upper surface 125 or a combination of both.

As is shown in FIGS. 6 and 7, outer surface 123 and rib 124 abut lower step portion 182*b* of ink supply port 180, 181, 182. Upper surfaces 119 and 125, and outer surface 121 of upper tubular portion 116 abut upper step portion 182*a* of ink supply port 180, 181, 182, and are preferably fixed to upper step portion 182*a* by means of an ink resistant adhesive 92. In this manner, a space S located between upper step portion 182*a* and upper surfaces 119 and 125 is completely-filled, and ink 67 is prevented from leaking around packing member 115.

In this way, each packing member 115 is fixed by tubular portions 116 and 117 to respective ink supply ports 180, 181, 182. Upward movement of packing member 115 is prevented by upper step portion 182*a* and lower step portion 182*b*. Thus, even when an ink supply needle is inserted or extracted, packing members 115 are adequately fixed to ink supply ports 180, 181, 182. Since taper portions 118 serve to attain the hermetic seal between packing member 115 and the ink supply needle of ink supply ports 180, 181, 182 by the respective thin connection portions 126, taper portion 118 may be flexed somewhat without causing deformation. Consequently, the air tight seal between packing member 115 and the ink supply needle can be maintained, while accommodating a relative misalignment between the respective ink supply needle and ink supply port.

As is shown in FIG. 6, seal 16, is preferably formed of a low-density polyethylene film that is very permeable to gas and impermeable to moisture, is secured over ink supply ports 180, 181, 182, and is capable of being breached by the ink supply needle prior to printing. A channel 127 located adjacent to ink supply ports 180, 181, 182, extending upward from bottom wall 162*a* into a dead space of protuberance 12 is provided as a space into which air that remains in ink supply ports 180, 181, 182 may be evacuated during the packaging process, described below. Channel 127 is sized such that channel 127 does not weaken the integrity of ink supply ports 180, 181, 182. Channel 127 is preferably located at the location of the dead space and proximal ink supply ports 180, 181, 182, exhaustion ports 190, 191, 192, or ink injection ports 100, 101, 102. However, channel 127 may also be located at any outer surface position of container body 1.

As is shown in FIG. 7, a pressing member 90, having a window 91, through which the ink supply needle (not shown) can pass, may be thermally welded to lower surface 182*c* of ink supply port 182 and lower surface 122 of packing member 115, thereby elastically pressing pressing member 90 against lower surfaces 122 and 182*c*, which in turn elastically deforms packing member 115 in ink supply port 180, 181, 182, and maintains the elastically deformed condition. Window 91 may be an opening or a thin piercable film. Thus, in accordance with the invention, air can be prevented from seeping around packing member 115 into communication path 14.

Figure 8A:
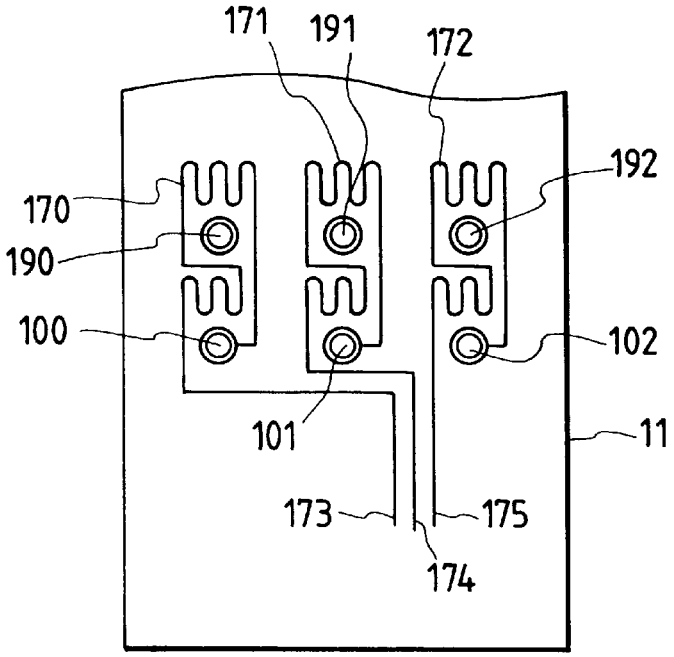
FIG. 8A is a schematic representation showing the plan view of a cover of the ink cartridge of FIG. 1 without a seal in place.
Figure 8B:
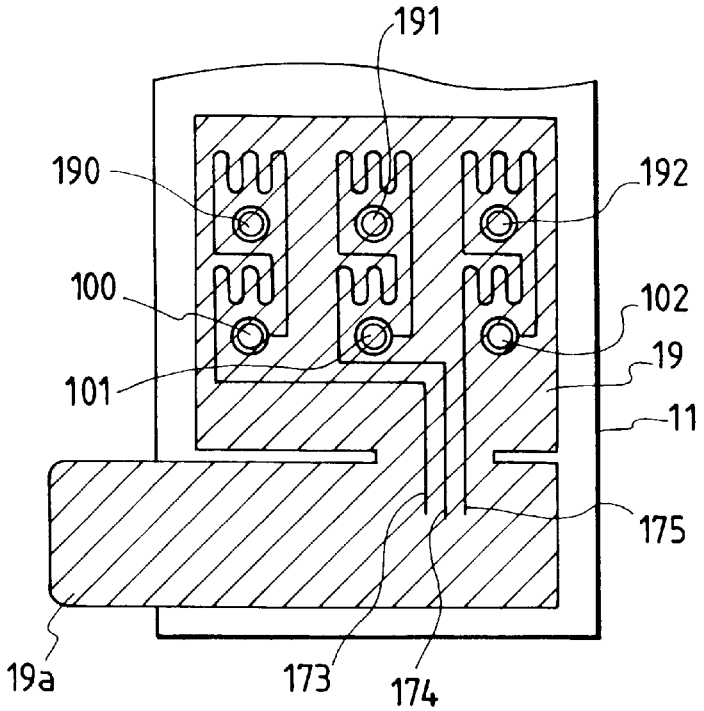
FIG. 8B is a schematic representation showing the plan view of the cover of FIG. 8A with a seal in place.

Referring to FIGS. 8A and 8B, a plan view of cover 11 is shown, wherein a plurality of grooves 170, 171, 172 are formed in cover 11 so as to extend across the surface of cover 11. Grooves 170, 171, 172 are connected at one end to respective exhaust ports 190, 191, 192 and at the other end to a plurality of respective air communication ports 173, 174, 175 formed in the inner surface of cover 11.

A seal 19 is secured to the surface of cover 11 so as to seal ink injection ports 100, 101, 102, exhaust ports 190, 191, 192, and grooves 170, 171, 172 from ambient air. Seal 19 is preferably formed with a low-density polyethylene material that is very permeable to gas and impermeable to moisture. Seal 19 includes a tongue 19*a*, which extends beyond cover 11, and is constructed to be easily grasped by a user. When tongue 19*a* is lifted, the seal between seal 19 and cover 11 is broken, and ambient air is provided to the interior of foam chambers 160, 161, 162, through exhaust ports 190, 191, 192, grooves 170, 171, 172, and air communication ports 173, 174, 175.

Figure 9:
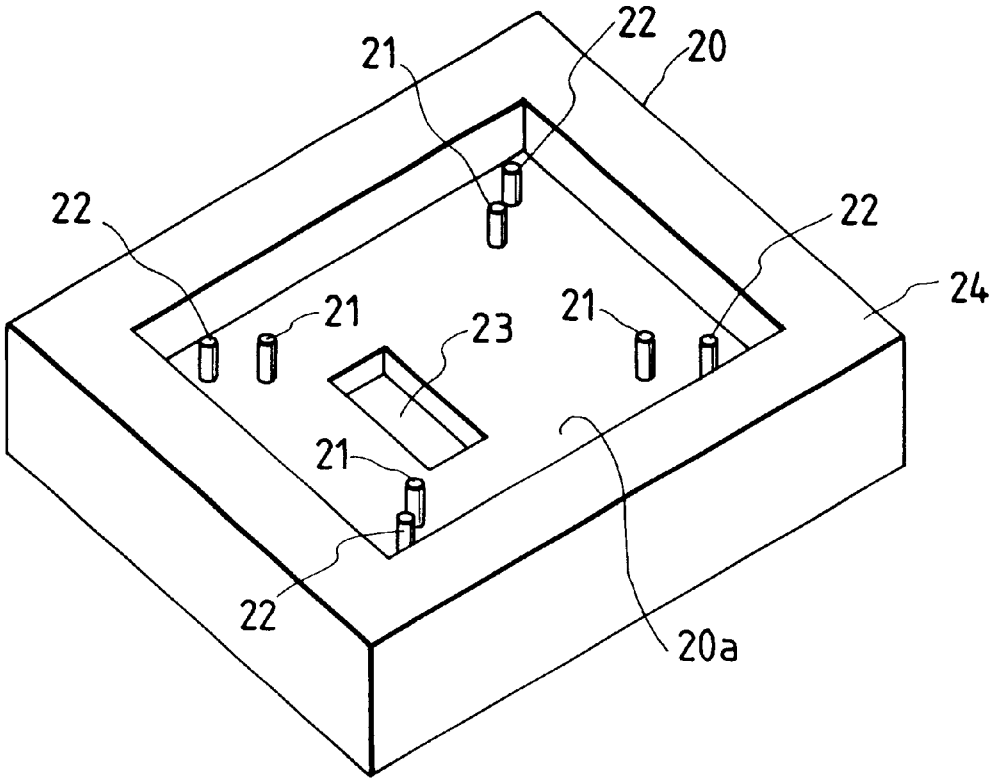
FIG. 9 is a perspective view showing a pallet for retaining and transporting a container body for use in the method of manufacturing an ink cartridge in accordance with an embodiment of the present invention.

A method of manufacturing ink cartridge 70 will now be described. FIG. 9 shows one embodiment of a pallet 20 formed in accordance with one embodiment of the invention, having a surface 20*a*, sized, spaced and arranged for transporting container body 1 during the course of the manufacture process. At least four inner pins 21 extend upwardly from pallet surface 20*a* sized, spaced and positioned for receiving the outer periphery of the surface of bottom wall 1*a* of container body 1. At least four outer pins 22 extend upwardly from pallet surface 20*a* sized, spaced and positioned for receiving an inner surface if of container body 1. An indentation 23 is formed in an area of pallet 20 corresponding to the intended location of ink supply ports 180, 181, 182, and a raised section 24 is formed along the edges of pallet 20, to form a sealing section during an ink filling step (described later). Pallet 20 is advantageously used to transport body 1 to various assembly stations during an assembly procedure, such as one employing an automated assembly line.

Pallet 20 may be formed of a metal, such as SUS steel having Ni plating, steel with Cr plating, or a plastic, such as polycarbonate, deformable PPO and/or POM, or the like, or any combination of metal and plastic.

Figure 10A:
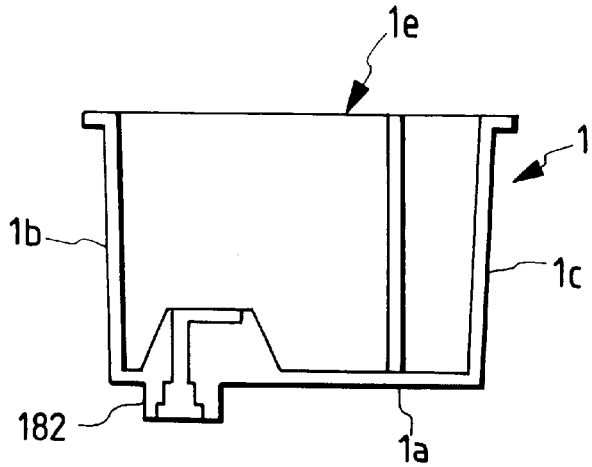
FIGS. 10A, 10B and 10C are diagrammatic representations showing initial steps of an ink cartridge manufacturing method of an embodiment of the present invention.
Figure 10B:
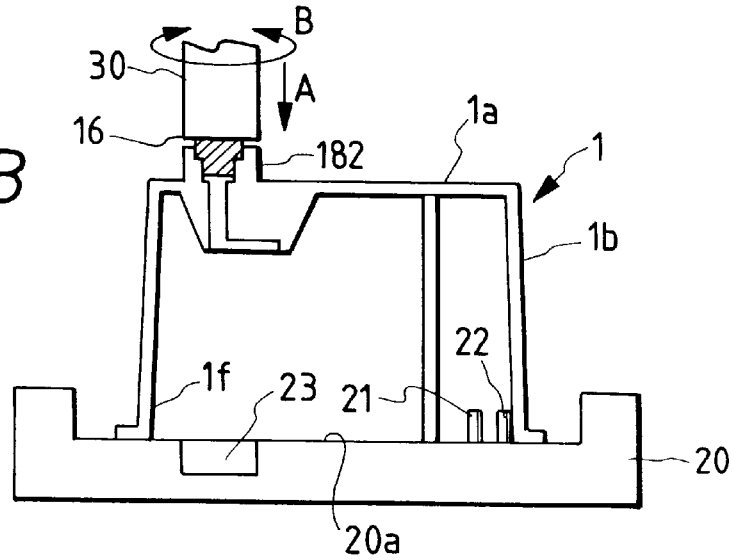

Referring to FIGS. 10A and 10B, container body 1 is positioned and set on pallet 20 by seating container body 1 in an upside-down position where bottom wall 1*a* of container body 1 faces upward and opening 1*e* faces pallet surface 20*a*, and inner surface if of container body 1 is positioned adjacent to pins 22, which hold body 1 to pallet 20. At this time, inner surfaces 1*f*, including filter 18, recess 13, protuberance 12, communication path 14, and ink supply port 180, 181, 182, of container body 1 may be exposed to ultraviolet radiation (or other suitable treatment) to improve the wettability of the surface.

Next, as is shown in FIG. 10B, packing member 115 having a thinly applied adhesive 92 on upper surfaces 119, 125 is temporarily pressed into ink supply port 180, 181, 182 by a pressing jig 36 in a direction indicated by an arrow A, and is further pressed in the direction of arrow A to a predetermined position while, at the same time, to reduce friction, pressing jig 30 rotates about the center axis of jig 30 in a direction shown by an arrow B. By pressing packing member 115 while also torquing packing member 115, packing member 115 is fitted into ink supply port 180, 181, 182 without curling or distorting the peripheral edge of ink supply port 180, 181, 182. Further, by press-fitting packing member 115, packing member 115 is reliably prevented from disengaging from ink supply ports 180, 181, 182 after foam chambers 271, 272, 278 have been filled with ink. Further, space S between packing member 115 and ink supply port 182 (FIG. 6), as well as the other corresponding spaces, are reliably filled and sealed with adhesive 92, thereby preventing air from entering container body 1 or ink from escaping container body 1 via space S.

Figure 10C:
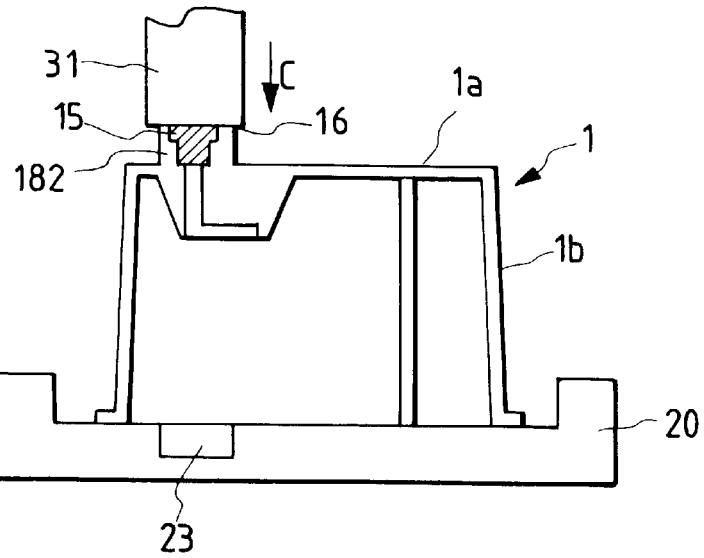

Referring to FIG. 10C, a seal 16 is positioned to cover each ink supply port 180, 181, 182, and the surrounding area of ink supply ports 180, 181, 182, and is then heated under pressure with a jig 31. In this way, ink supply ports 180, 181, 182 arc sealed with seal 16. At this stage of manufacturing, a lot number or an expiration date can be inscribed on bottom wall 1*a* or side wall 1*d*, or otherwise, as required.

Figure 11:
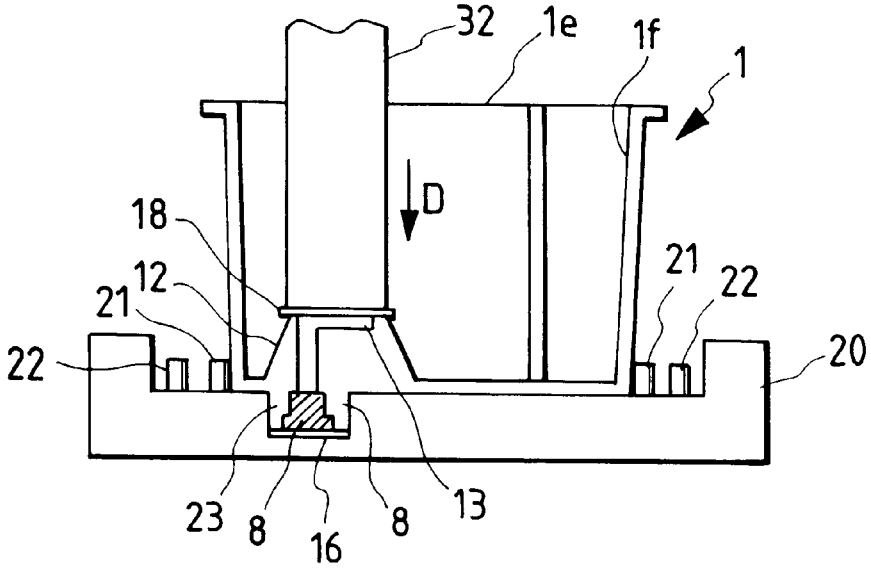
FIG. 11 is a diagrammatic representation showing a step of attaching a filter to a ink supply port inlet according to an ink cartridge manufacturing method of the present invention.

After bottom wall 1*a* of container body 1 has finished undergoing the above-described operations, as is shown in FIG. 11, container body 1 is re-positioned on pallet 20 such that opening 1e of container body 1 faces upward and bottom wall 1*a* is flush with pallet surface 20*a*. The repositioning can be done manually, robotically or otherwise.

Next, as is shown in FIG. 11, filter 18 is positioned to cover recess 13, and is preferably heat welded under pressure until container body 1 becomes slightly soft to create a bond between filter 18 and protuberance 12. Filter 18 can be formed by cutting a piece of filtering material, such as a rust-proof steel mesh or non-woven fabric, into a filter having an area slightly larger than the area of recess 13 formed in protuberance 12.

One way of fitting filter 18 to protuberance 12 is to press the filtering material into a shape that matches the profile of protuberance 12, e.g., a circular or ovate pattern. However, where filter 18 is formed by weaving rust-proof steel wires, the unraveling of filter 18 can be prevented by cutting filter 18 at an angle with respect to the warp and woof directions of the weave. In this manner, the wires of filter 18 are prevented from unintentionally extending into the area occupied by packing member 115, where they could become sandwiched between the ink supply needle of the recording head and packing member 115 when ink cartridge 70 is attached to the recording head. If a wire is positioned in that way, the air-tight seal formed between the ink supply needle and ink cartridge 70 could be reduced, and the ink supply needle could become clogged, thereby hindering the supply of ink 67 to the recording head. Thus, preventing the fraying of filter 18 helps ensure a reliable ink supply.

Figure 12:
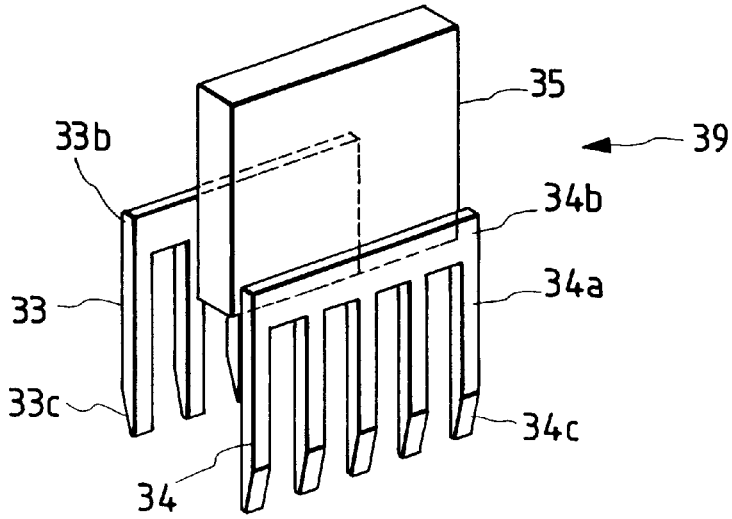
FIG. 12 is a perspective view showing one embodiment of a porous member insertion device used in an ink cartridge manufacturing method of the present invention.
Figure 13A:
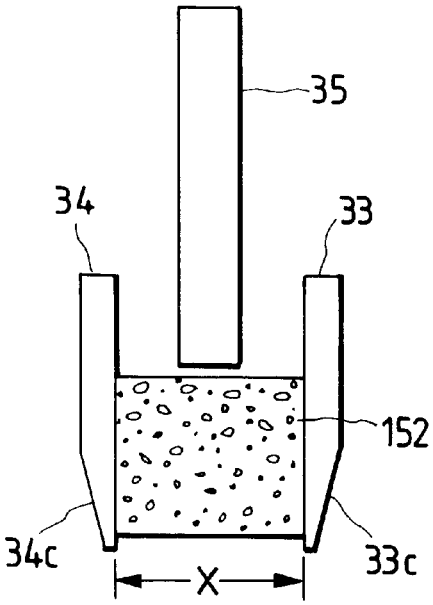
FIGS. 13A, 13B and 13C are diagrammatic representations showing a step of inserting the porous member into the foam chamber of the container body in accordance with an ink cartridge manufacturing method of the present invention.
Figure 13B:
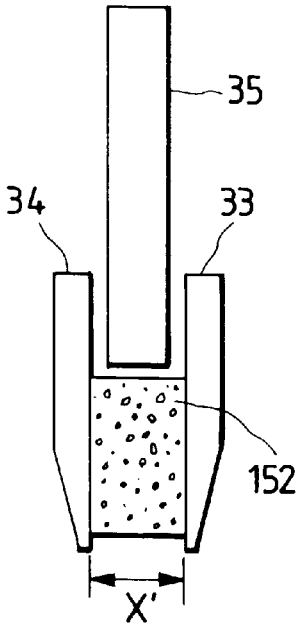
Figure 13C:
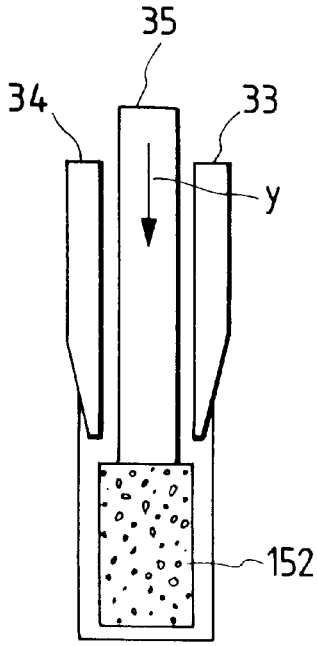

Referring to FIGS. 12 and 13–13C, the steps of press-fitting porous member 152 into each foam chamber 160, 161, 162 will now be described. FIG. 8 shows a porous member insertion device 39 constructed in accordance with an embodiment of the invention. FIGS. 13A–13C depict a method for inserting porous member 152 into foam chamber 162. It is understood that the remaining porous members 150 and 151 are similarly pressed into foam chambers 160 and 161, respectively.

As shown in FIG. 12, porous member insertion device 39 comprises compression members 33 and 34, which are comb-shaped, and a press member 35 which is interposed between compression members 33 and 34. Compression members 33 and 34 include bases 33*b*, 34*b* and teeth 33*a*, 34*a*, which extend downwardly from bases 33*b* and 34*b*, respectively. The width between teeth 33*a* and 34*a* in a horizontal direction is shown as a double arrow X in FIG. 13A. Teeth 33*a* and 34*a* taper to free end 33*c* and 34*c*, respectively. Compression members 33 and 34 are moveable in the X direction by an activation means (not shown) to decrease the width to X', as shown in FIG. 13B.

As is shown in FIG. 13A, porous member 152 is sandwiched between compression members 33, 34 by actuation of compression members 33 and 34 toward press member 35 opposite the X direction until the distance between the outer edges of compression members 33 and 34 is smaller than the inner width of foam chamber 162. As such, porous member 152 is compressed to a size X' that fits within foam chamber 162.

Figure 14:
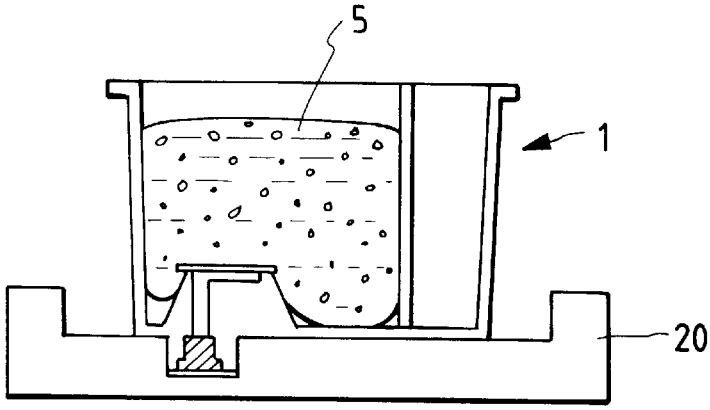
FIGS. 14–16 are diagrammatic representations showing intermediate steps in accordance with an ink cartridge manufacturing method of the present invention.

At this time, porous member insertion device 39 is positioned over foam chamber 162, such that tapered ends 33*c* and 34*c* of teeth 33*a* and 34*a* fit within foam chamber 162, and press member 35 is actuated by an activating means (not shown) to urge foam chamber 162 in the direction show n as an arrow Y in FIG. 13C. In this way, as depicted in FIG. 13C, porous member 152 is pressed into foam chamber 162. Subsequently, press member 34 is lowered slightly further, and container body 1 is transported away from porous member insertion device 39. As a result, as shown in FIG. 14, porous member 152, which is formed so as to be slightly larger than the volume of foam chamber 162, is positioned in foam chamber 162 in a compressed state.

Figure 15:
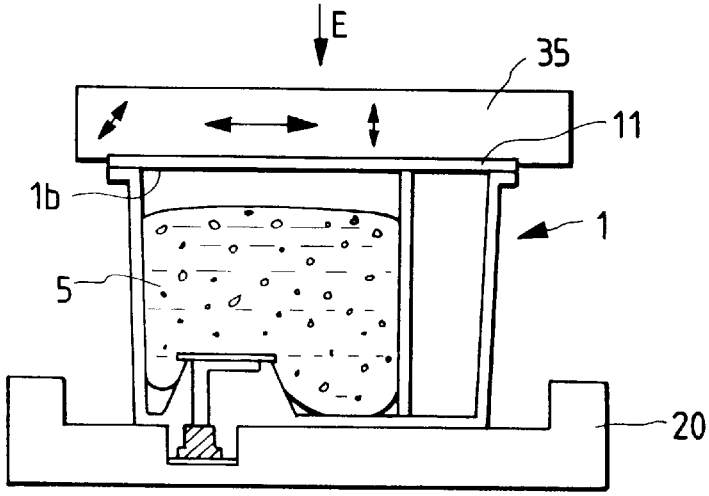

Next, as is shown in FIG. 15, cover 11 is positioned over opening 1*e* of container body 1 and is pressed toward container body 1 by a pressing means at a specified pressure in a direction indicated by arrow E. Further, by way of a jig 35, ultrasound vibrations are applied to cover 11 in the same plane as cover 11, in a direction perpendicular to cover 11, in a direction oblique to cover 11, or in a combination thereof. Thus, opening 1*e* of container body 1 is frictionally fused (ultrasonically welded) to the reverse side of cover 11.

Figure 16:
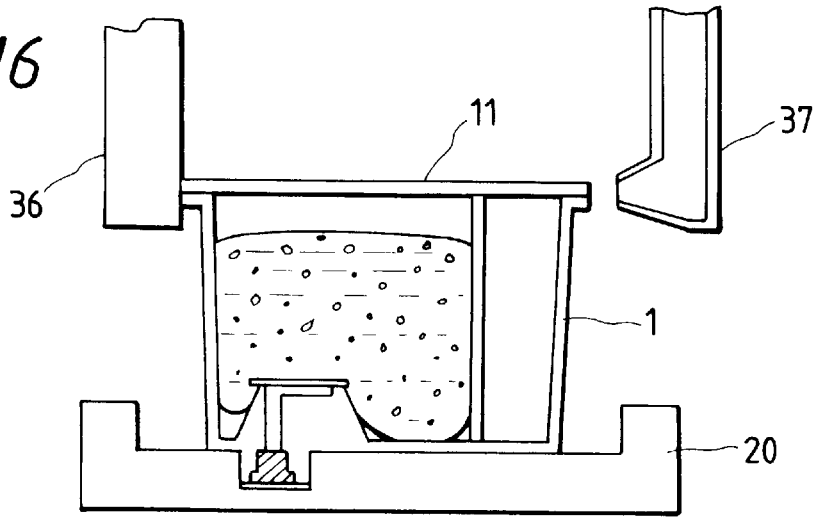
Figure 19:
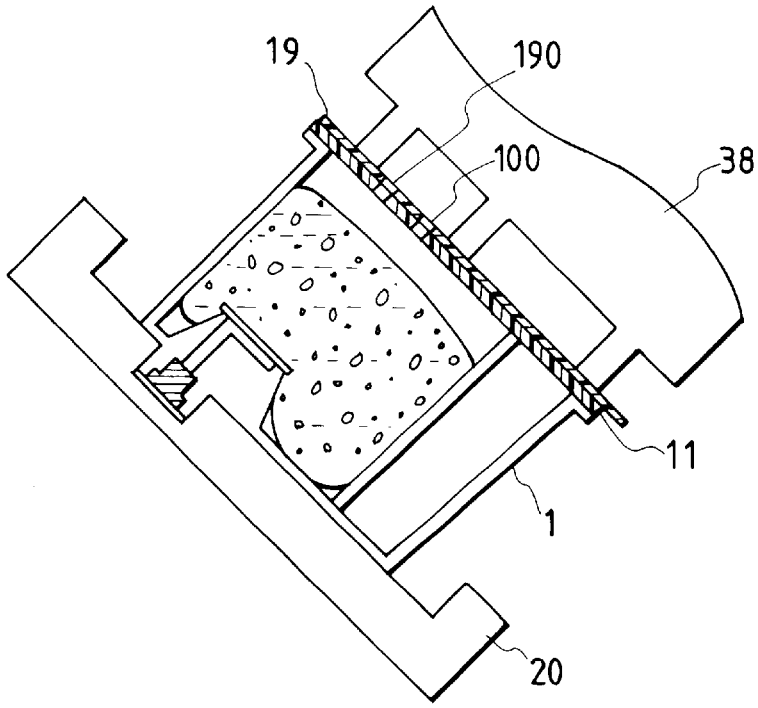
FIG. 19 is a schematic representation showing a step of sealing the cover in accordance with an ink cartridge manufacturing method of the present invention.

Referring to FIG. 16, after cover 11 is fused to container body 1, a heat rod 36, which is heated to a temperature sufficient to soften the material of container body 1 and cover 11, is brought into contact with the periphery of a heating plate or jig 38 shown in FIG. 19, thereby ensuring that heating plate 38 fuse-bonds (heat seals) seal 19 to cover 11. Hot air is then blown from an injection nozzle 37 onto container body 1, so as to help eliminate any burrs resulting from the attachment of cover 11 to container body 1.

Figure 17:
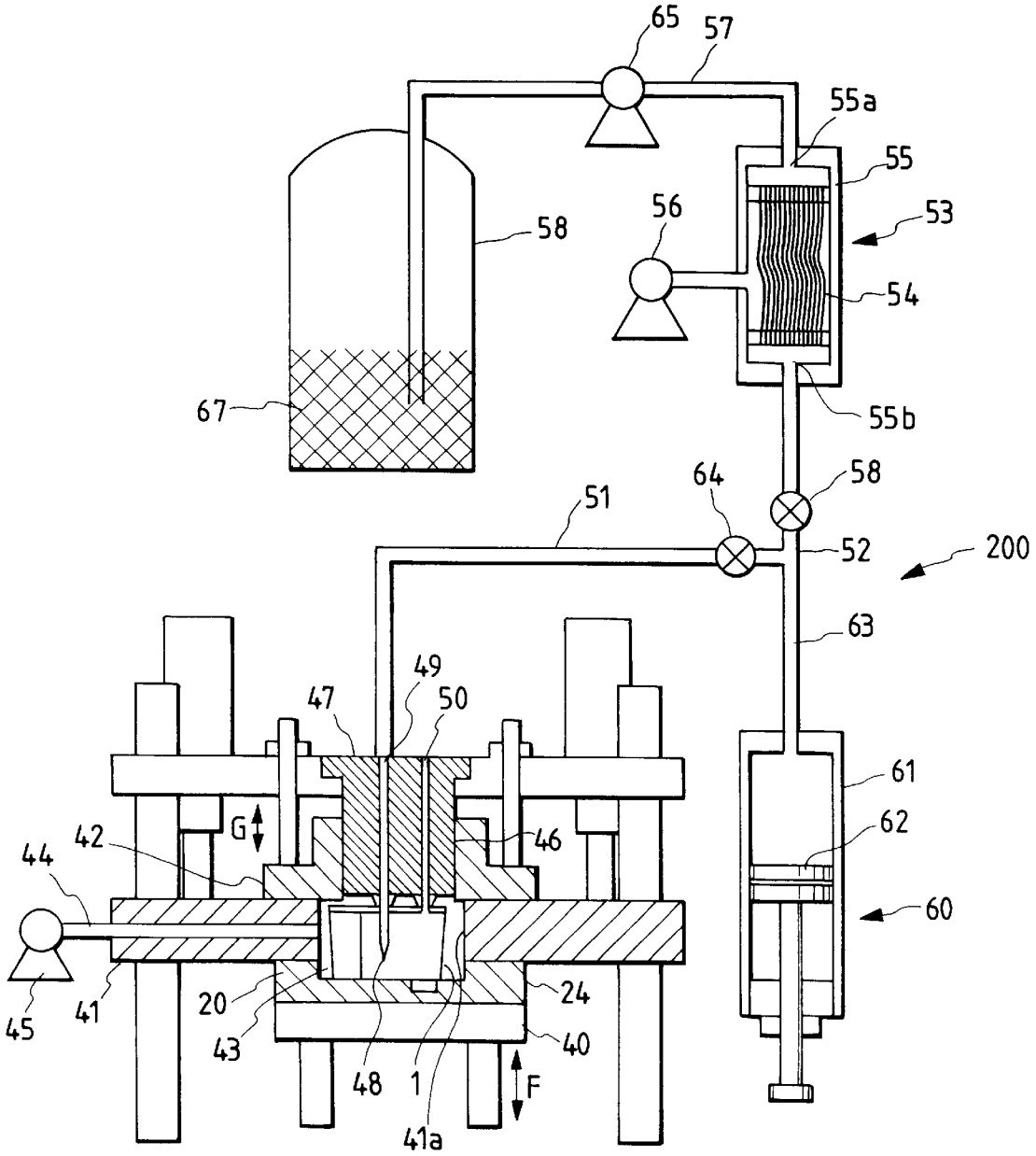
FIG. 17 is a block diagram showing of an ink filling apparatus for use with an ink cartridge manufacturing method of a preferred embodiment of the present invention.

After the assembly of the ink container, the container is transported on pallet 20 to an ink filling station. FIG. 17 shows an ink filling apparatus 200, constructed in accordance with one embodiment of the invention. Filling apparatus 200 includes a table 40 for supporting pallet 20. Table 40 can be vertically actuated in the direction indicated by a double arrow F by means of a drive mechanism (not shown).

At this point in the process, container body 1 remains seated in pallet 20 in its upright position. A bed 41, having a through hole 41*a*, formed to accommodate container body 1, is positioned on a raised section 24. An injection chamber 43 is formed in through hole 41*a* by the combination of pallet 20, which forms a lower surface of chamber 43, and a cover member 42 which forms an upper surface of chamber 43. Injection chamber 43 is connected to a vacuum pump 45 via a channel 44 formed in bed 41.

A through hole 46 is formed in cover member 42 so as to oppose injection chamber 43. A piston 47 is inserted into through hole 46, and is constructed to maintain injection chamber 43 in an air-tight state while moving vertically in a direction indicated by a double arrow G. Piston 47 includes an injection needle 48, positioned to face ink injection ports 100, 101, 102 of container body 1, set in injection chamber 43, and a channel 50, which faces atmospheric communication ports 190, 191, 192 of container body 1, and is connected to an air supply device (not shown). Injection needle 48 is connected to a branch tube 52 via a channel 49 formed in piston 47, a tube 51, and a stop valve 64.

Ink filling apparatus 200 also includes a gas-liquid separation unit 53. In one preferred embodiment of the invention, gas-liquid separation unit 53 includes a hollow yarn bundle 54, which is preferably connected fluid-tight at both longitudinal ends to a cylinder 55 so as to permit fluid to flow therethrough. Cylinder 55 is connected to a vacuum pump 56 so as to produce negative pressure around the outer periphery of yarn bundle 54. Cylinder 55 includes an inlet 55*a*, which is connected to an ink tank 58, having ink 67 therein, via a tube 57, and an outlet 55*b*, which is connected to branch pipe 52 via a stop valve 58.

Branch pipe 52 is also connected to a measuring tube 60 via a tube 63. Measuring tube 60 includes a cylinder 61 and a piston 62, and is preferably connected to branch pipe 52 at the center of one end of cylinder 61.

Figure 18A:
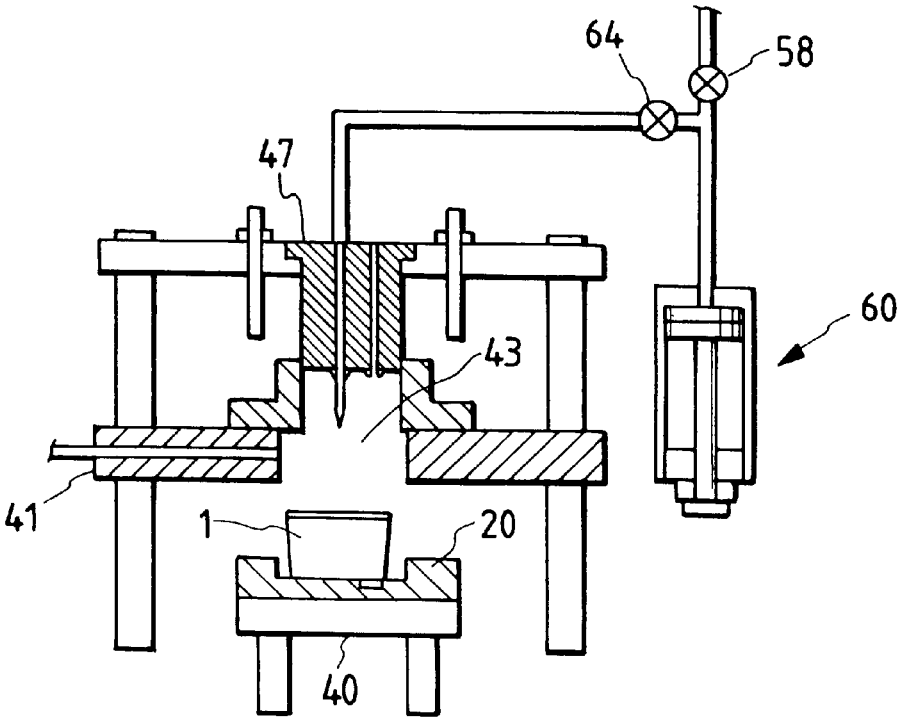
FIGS. 18A to 18E are schematic representations showing a step of the ink injection process in accordance with an ink cartridge manufacturing method of the present invention.
Figure 18B:
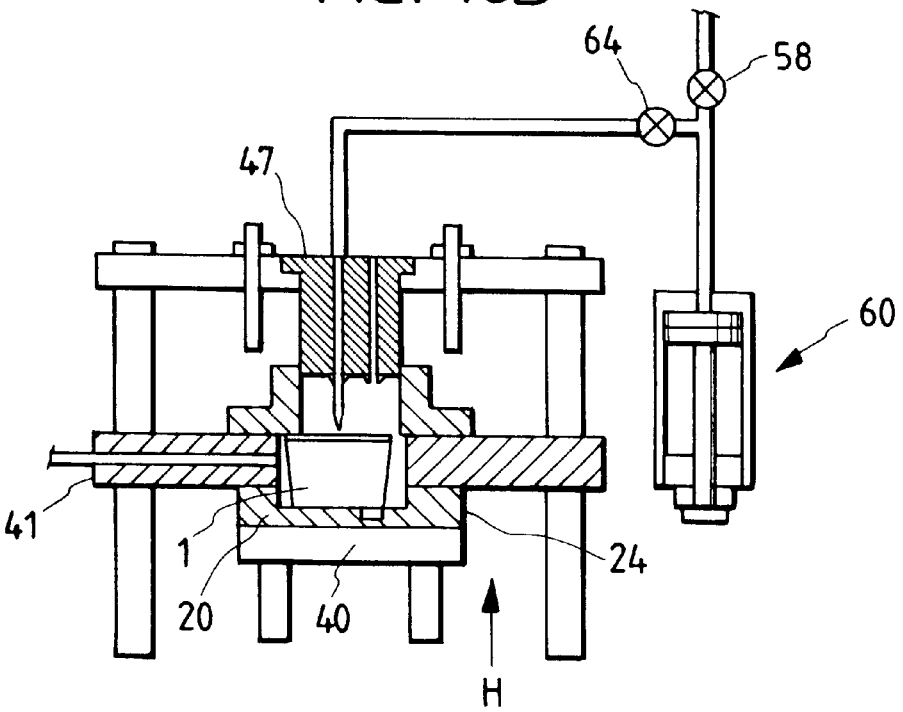

After container body 1 has been assembled, it is transported on pallet 20 to ink injection apparatus 200, and is set below injection chamber 43, as is shown in FIG. 18A. Table 40 is then raised in a direction H until raised portion 24 of pallet 20 comes into close contact with a lower surface of bed 41, as shown in FIG. 18B.

Figure 18C:
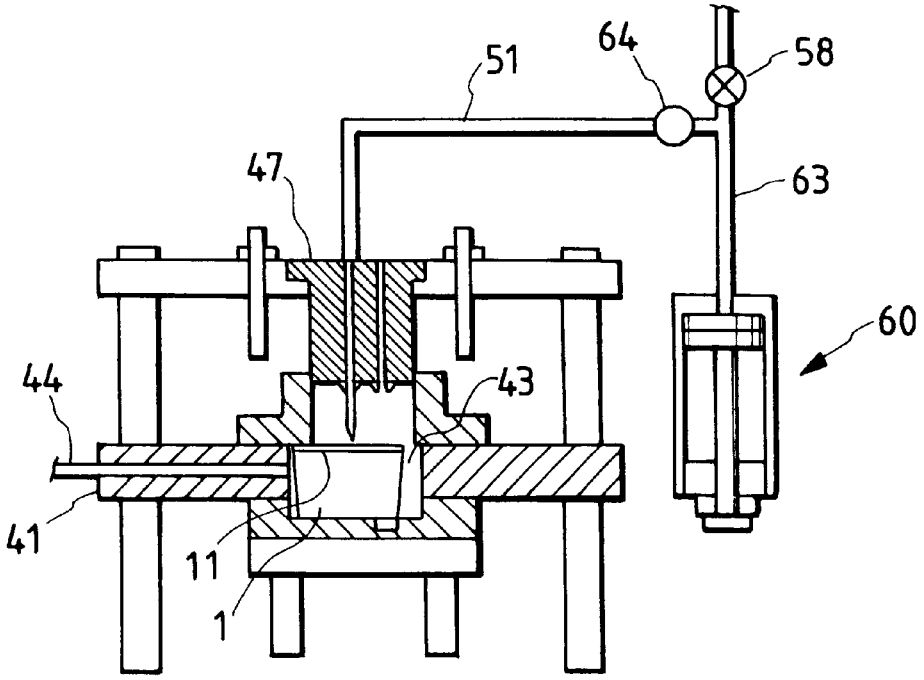

Subsequently, referring to FIG. 18C, piston 47 is lowered such that a gap exists between piston 47 and cover 11 of container body 1 and piston 47 forms a seal with cover member 42. Stop valve 64 is then opened while maintaining stop valve 58 connected to the gas-liquid separation unit 60 in a closed position. A vacuum pump 45, which is connected via channel 44 to injection chamber 43, is then activated to depressurize injection chamber 43, tubes 51 and 63, and measuring tube 60 to a predetermined pressure.

Figure 18D:
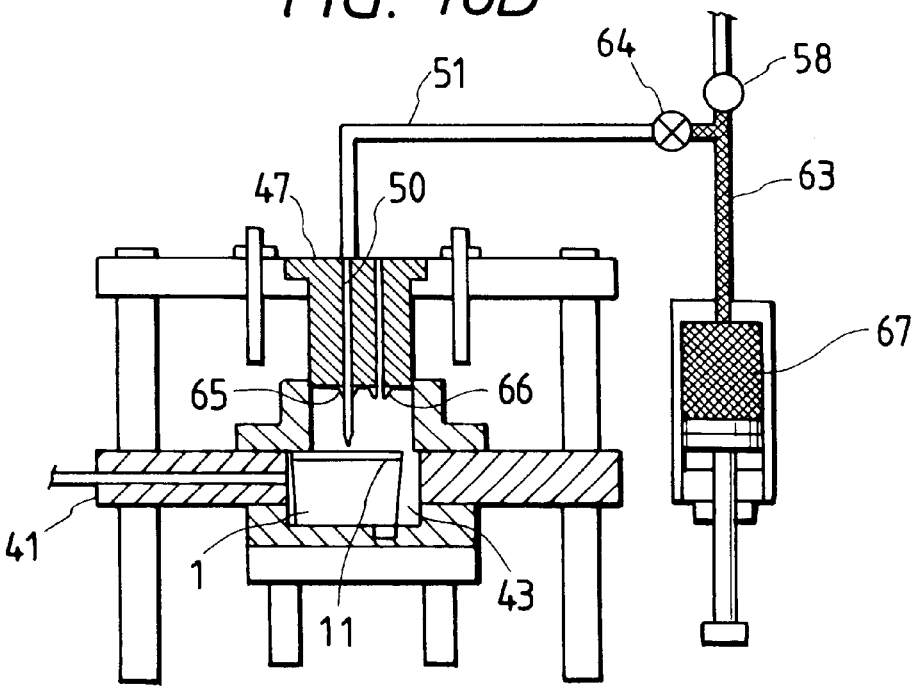
Figure 18E:
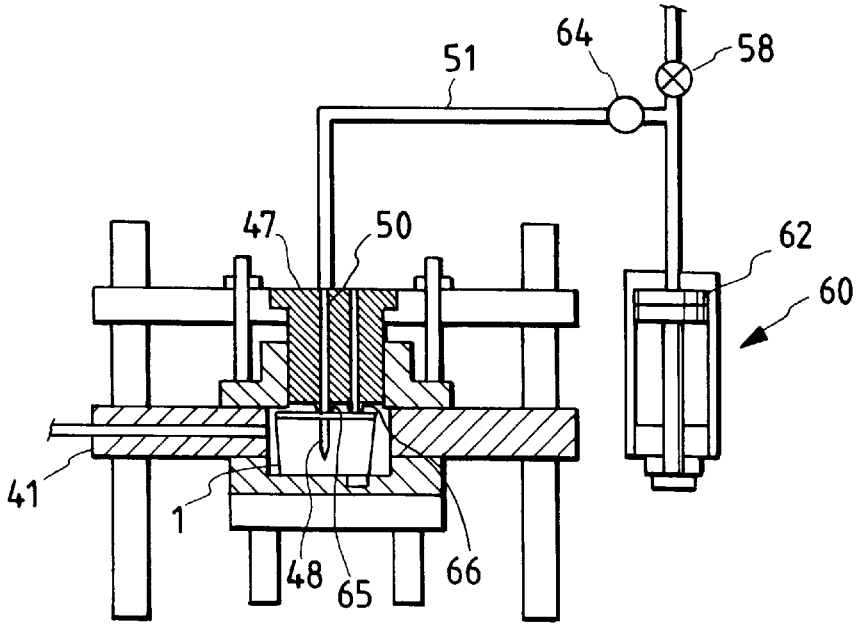

Referring to FIG. 18D, when injection chamber 43 and tubes 51, 60 and 63 have been evacuated to a predetermined pressure, stop valve 64 is closed. Thereafter, measuring tube 60 is placed in fluid communication with gas-liquid separation unit 53 by opening stop valve 58, and a predetermined quantity of ink 67 is filled into measuring tube 60. In conjunction with this operation, as is shown in FIG. 18E, piston member 47 is lowered such that packing members 65, 66 formed on the lower end of piston member 47 are brought into elastic contact with ink injection port 100 and atmospheric port 190 of container body 1, respectively. Further, injection needle 48 is positioned in fluid communication with container body 1, as it is inserted through ink inlet port 100 into the vicinity of the bottom of container body 1. Since gas-liquid separation unit 53 is connected close to measuring tube 60, ink flows into measuring tube 60 immediately after having been degassed by gas-liquid separation unit 53.

Next, as shown in FIG. 18E, stop valve 58 is closed to isolate gas-liquid separation unit 53, stop valve 64 is opened, and piston 62 of measuring tube 60 is pressed to discharge the predetermined quantity of ink 67 into foam chamber 160 via ink injection port 100. At this time, ink 67, which has been completely degassed by gas-liquid separation unit 53, is absorbed into porous member 150. As a result, gas trapped in the pores of porous member 150 that were not discharged in the foregoing depressurization step, readily dissolves into ink 67. Therefore, ink 67 is uniformly absorbed by porous member 150 without causing air bubbles to form in porous member 150. When foam chamber 160 is filled with ink 67, air bubbles do not exist in at least porous members 150, and because air bubbles are not introduced via channel 50, ink 67 provided to the recording head via the porous member 150 is free of bubbles, thereby ensuring print quality.

While ink 67 is being injected into ink container 1, tube 51 is advantageously heated to a temperature of at least approximately 10 to 20° C. above the ambient temperature, so that ink 67 becomes less viscous and may more easily enter the pores of porous member 150. In this manner, any gas that had previously been contained in porous member 150 is more readily displaced by ink 67, thereby further ensuring reliable ink ejection and high quality. The remaining foam chambers 161, 162 are filled with ink by a similar process.

Upon completion of the ink filling process, channel 50 is opened to ambient air, so that ink 67 that remains on an upper part of porous member 150 is completely absorbed into porous member 150 by means of the pressure differential between the pressure in porous member 150 and ambient pressure. Subsequently, table 40 is lowered, and pallet 20 is transported to the next assembly station. The other porous members can be filled with ink in a similar fashion. Any ink that has adhered to ink injection port 100 during the filling process can be wiped off by vacuum suction or with a cloth. Finally, a conduit (not shown) is advantageously brought into contact with ink injection port 100, and a very small positive suction is applied to the conduit, thereby suctioning any ink adhered to the reverse side of cover 11.

Next, as is shown in FIG. 19, container body 1 is housed in a depressurization container 38 and is inclined in such a way that exhausting ports 190, 191, 192 face upward. Seal 19 is formed so as to cover at least exhaustion ports 190, 191, 192, the ink inlet ports 100, 101, 102 and grooves 170, 171, 172 and can be temporarily adhered to cover 11 by heat welding or otherwise. Prior to sealing cover 11, if there is an increase in the pressure within container body 1 due to an increase in temperature, exhaustion ports 190, 191, 192 are immediately raised to a higher position, and hence the expanded air is immediately discharged from exhaustion ports 190, 191, 192. As a result, ink is prevented from leaking from ink inlet ports 100, 101, 102.

Next, the area of seal 19 covering grooves 170, 171, 172 is heated, so that a part of seal 19 is welded to the surface of cover 11 such that is scaled. In this process, capillaries are formed by grooves 170, 171, 172 and seal 19. The principal portion of the remainder of seal 19 is adhered to cover 11 such that it can be readily peeled away from cover 11.

In another embodiment of a method of manufacturing ink tank cartridge 1, after heat fusing seal 19 to cover grooves 170, 171, 172, the additional step of housing the ink cartridge in an evacuation chamber and evacuating ink cartridge 1 prior to the other portion of seal 19 being heat fused to cover 11 is performed. In this manner, ink cartridge 1 may be decompressed again to prevent the formation of foam in the vicinity of packing member 115. Preferably, ink cartridge 1 is evacuated to approximately 200 mm Hg (−200 mm) below atmospheric pressure so that ink 67 may be prevented from being ejected from ink inlet ports 100, 101, 102, thereby maximizing the amount of ink 67 contained in ink cartridge 1.

Thus, an ink cartridge can be efficiently manufactured by transporting the ink cartridge on the pallet at several or each step of the manufacturing process.

As shown in FIG. 20, in an ink-filled ink cartridge 70, at least ink supply ports 180, 181, 182 are bought into contact with a buffer 71 so as to prevent seals 16 from rupturing. As is described above, it is understood that each ink supply port 180, 181, 182 is sealed with a seal 16. Further, tongue 19*a* of seal 19 is folded, and ink cartridge 70 is then inserted into a bag 72, which is preferably formed from a gas-insulating film, and has a collar 72*a*. Collar 72*a* is arranged near the opening of bag 72, and is folded inwardly to a uniform thickness. The opening of bag 72 is heat welded in a vacuum environment as shown in FIG. 21A.

When the vicinity of the opening of bag 72 is thermally welded and sealed under a decompressed environment as shown in FIG. 21B, channel 127 provided in the vicinity of ink supply port 182 and any other space within bag 72 forms decompressed space. As such, because seals 16 are composed of a low-density polyethylene film which is very permeable to gas, the air dissolved in ink 67 in the vicinity of ink supply port 180, 181, 182 passes through seals 16 and is contained in the decompressed space provided in channel 127 and bag 72. In this manner, the amount of air dissolved in ink 67 in the vicinity of ink supply port 180, 181, 182 can be minimized and foams can be prevented from flowing into the recording head. Preferably, this step is performed within approximately 72 hours after the second depressurization step.

The quantity of dissolved air in ink cartridge 70 is minimized and foams are prevented from forming by composing seal 16 for sealing ink supply port 180, 181, 182 and seal 19 for sealing ink injection ports 100, 101, 102, exhaustion ports 190, 191, 192, and grooves 170, 171, 172 of cover 11 by a film, such as a low-density polyethylene film, that is very permeable to gas and is not permeable to moisture. As such, when bag 72 is sealed in a decompressed environment, dissolved air in ink cartridge 70 passes through seal 16 or seal 19 and is contained in the decompressed space provided in channel 127 and bag 72.

Particularly, if ink is first filled in the recording head, it is desirable that ink in ink cartridge 70 is held in a vacuum of approximately −200 or even −300 mm Hg to securely dissolve foams in ink 67 and remove the foams by permitting the air to pass through seal 16 or seal 19. When ink 67 is held in a high degree of degassing as described above, it is desirable that the volume of channel 127 be increased. As such, a concave portion and a through hole (not shown) are provided to thick cushioning material 71 to positively form dead space between bag 72 and ink cartridge 70 and a spacer is provided for sealing.

Finally, as is shown in FIG. 21B, the packaged ink cartridge 70 is inserted into a case 73, and is ready to be shipped as a product. Where ink cartridge 1 is packed as an accessory of a recording apparatus, it is desirable that ink cartridge 1 indicate when ink 67 has a high degree of degassing and when ink 67 has a slightly lower degree of degassing. As such, an indicating mark and color are printed on case 73 so that these two types of ink cartridges may be easily distinguished.

Figure 22:
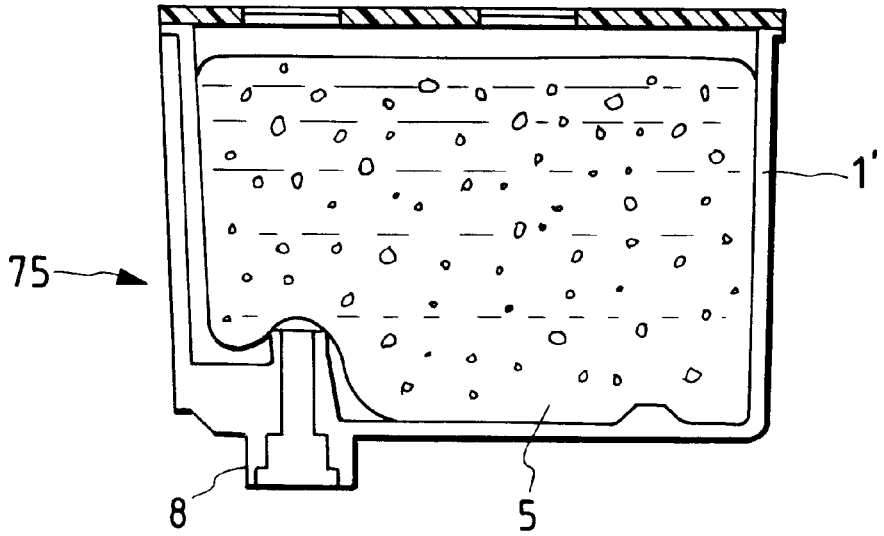
FIG. 22 is a schematic representation showing an ink cartridge manufactured according to a second embodiment of the present invention.

Although the present invention has been described with reference to the cartridge having multiple ink chambers, the present invention can be applied to the manufacture of an ink cartridge 75 such as that shown in FIG. 22, where ink is only filled into porous member 5 housed in container body 1'.

Figure 23:
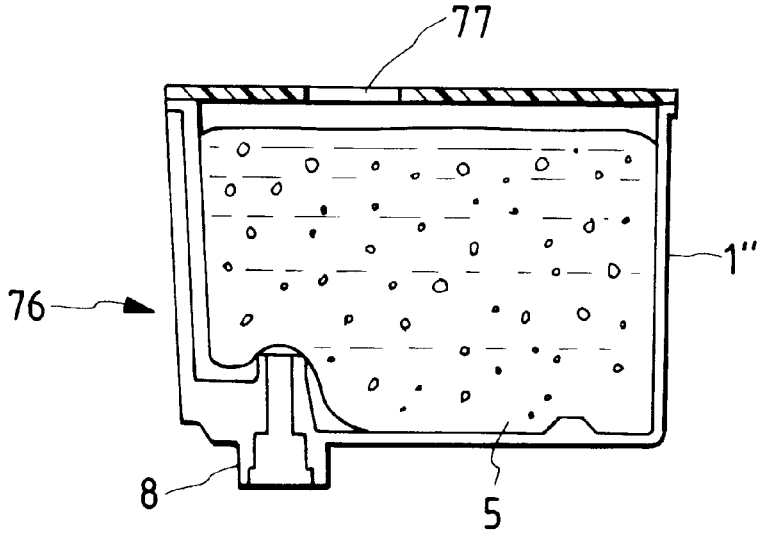
FIG. 23 is a schematic representation showing an ink cartridge manufactured according to a third embodiment of the present invention.
Figure 24:
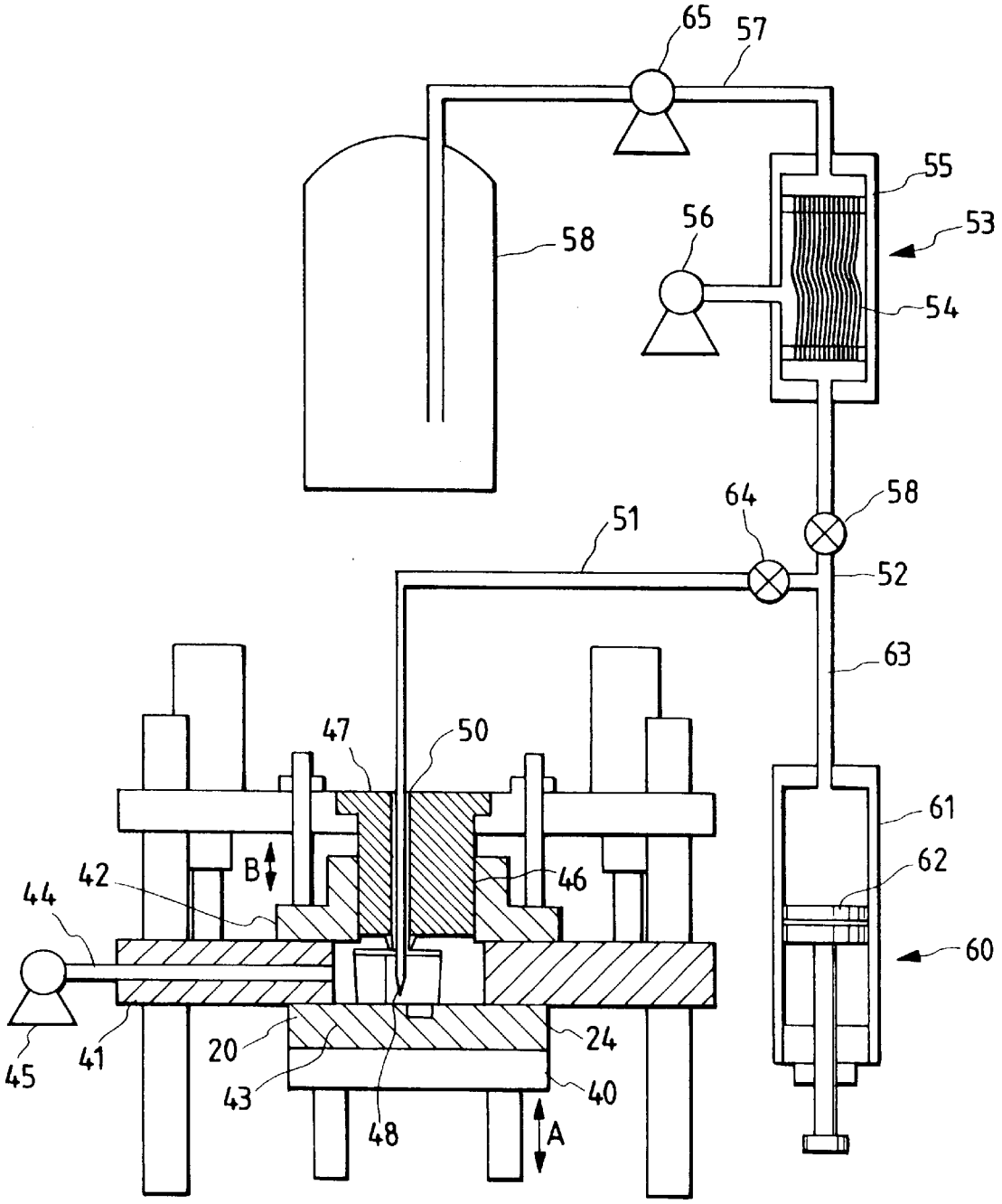
FIG. 24 is a block diagram showing an ink filling apparatus for use with an ink cartridge Manufacturing method of a second embodiment of the present invention.

Further, in the case of a small cartridge 76 having a body 1", shown in FIG. 23, only one opening 77 may be formed in a cartridge 76 so as to serve as an ink inlet port and an atmospheric communication port. In such a case, as shown in FIG. 24, ink injection needle 48 and channel 50 connected to the exhaust device (not shown) are provided coaxially with respect to each other. As such, one opening 77 can be used both for ink injection and air exhaust operations.

It will thus be seen that the objects set forth above, among those made apparent from the preceding description are efficiently obtained and, since certain changes may be made in carrying out the above method and in the constructions set forth without department from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink tank cartridge for use in an ink jet recording apparatus, comprising:

a tank body having exterior walls;

a porous member stored in said tank body;

an ink supply port configured to receive an ink supply needle of an ink jet recording head, the supply port having an inner surface, defined by and extending through one of said exterior walls of said body to supply ink to the exterior of the cartridge;

a packing member disposed within said ink supply port said packing member having an opening therethrough, a lower surface and, an upper surface facing said tank body; and a rib disposed between the upper surface and the tank body, said rib circumscribing said opening.

2. The ink tank cartridge of claim 1, comprising an adhesive layer attaching said packing member to said inter surface.

3. The ink tank cartridge of claim 2, wherein said adhesive layer is ink-resistant.

4. The ink tank cartridge of claim 1, comprising a pressing member having a window, the pressing member pressing against said lower surface of said packing member and biasing said packing member against said inner surface of said ink supply port.

5. The ink tank cartridge of claim 4, wherein said rib is maintained in an elastically deformed condition as a result of the pressing from the pressing member said rib.

6. The ink tank cartridge of claim 4, wherein said window is a thin film.

7. The ink tank cartridge of claim 4, wherein said pressing member is thermally welded to said body.

8. The ink tank cartridge of claim 1, wherein the inner surface of the ink supply port has been treated to increase the hydrophilic properties thereof.

9. An ink tank cartridge for use in an ink jet recording apparatus, comprising:

a tank body having a plurality of exterior walls defining an interior space;

at least one porous member within said interior space of the tank body;

at least one port extending through one of said exterior walls of said body;

a gas-permeable seal for sealing said at least one port; and a gas-impermeable bag for enclosing the ink tank cartridge and defining a decompressed dead space between said as impermeable bag and ink tank body into which gas dissolved in said tank body can flow via said ink supply port and said gas-permeable seal when said ink tank cartridge is enclosed with in the gas impermeable bag.

10. The ink tank cartridge of claim 9, wherein at least one of said plurality of exterior walls has an outer surface defining a channel therein, at least in part defining said decompressed dead space.

11. The ink tank cartridge of claim 9, wherein said tank body has an interior and said at least one port is configured and coupled to the interior of the tank body to serve as an ink port for supplying ink to the exterior of the cartridge or injecting ink into the interior of the tank body.

12. The ink tank cartridge of claim 9, wherein said tank body has an interior and said at least one port is configured and coupled to the interior of the tank body to serve as an exhaustion port for exhausting gas from the interior of the tank body.

13. The ink tank cartridge of claim 9, wherein said gas-permeable seal comprises a low-density polyethylene film.

14. The ink tank cartridge of claim 9, further comprising a cushioning material to positively form dead space outside the ink cartridge.

* * * * *